US006661387B2

(12) United States Patent
Yang

(10) Patent No.: US 6,661,387 B2
(45) Date of Patent: Dec. 9, 2003

(54) ANTENNA DEVICE FOR ATTACHING ONTO VARIOUS OBJECTS

(76) Inventor: A Sheng Yang, 6F, No. 440-2, Gin Pin Road, Chong Ho City, Taipei Hsien (TW), 235

( * ) Notice: Subject to any disclaimer, the term of this patent is extended or adjusted under 35 U.S.C. 154(b) by 0 days.

(21) Appl. No.: 10/124,832

(22) Filed: Apr. 16, 2002

(65) Prior Publication Data

US 2003/0193440 A1 Oct. 16, 2003

(51) Int. Cl.[7] ..... H01Q 21/00
(52) U.S. Cl. ..... 343/713; 343/711
(58) Field of Search ..... 343/713, 725, 343/700 MS, 711, 702, 715, 705; 340/425.5, 426

(56) References Cited

U.S. PATENT DOCUMENTS 6,023,218 A * 2/2000 Tremblay ..... 340/425.5
6,023,245 A * 2/2000 Gomez et al. ..... 343/725

* cited by examiner

*Primary Examiner*—James Clinger

(57) ABSTRACT

An antenna device includes an antenna member secured on a seat, a circuit board disposed between the seat and the antenna member, a light device attached to the circuit board, and one or more magnetic members for magnetically attracting the seat to various objects, such as the vehicles, and for allowing the antenna device to be moved or adjusted to any suitable positions or places of the vehicle. One or more casings may be used for securing the magnetic members to the seat. The light device may generate the lights for warning or for decorative purposes.

3 Claims, 8 Drawing Sheets

ANTENNA DEVICE FOR ATTACHING ONTO VARIOUS OBJECTS

BACKGROUND OF THE INVENTION

1. Field of the Invention

The present invention relates to an antenna device, and more particularly to an antenna device for attaching onto various objects with magnetic members.

2. Description of the Prior Art

Typical antenna devices are attached to or received in the front or rear portions of the vehicles, and may be extended outward for receiving signals from the other broadcasting stations. However, the antenna devices may not be moved or changed to the other places or positions. In addition, the antenna devices normally have no light devices for generating warning lights, particularly during the night or in the dark environment.

The present invention has arisen to mitigate and/or obviate the afore-described disadvantages of the conventional antenna devices.

SUMMARY OF THE INVENTION

The primary objective of the present invention is to provide an antenna device for attaching onto various kinds of objects with magnetic members.

The other objective of the present invention is to provide an antenna device which may be moved or adjusted to various places or positions of the vehicles.

The further objective of the present invention is to provide an antenna device having a light device for generating warning lights during the night or in the dark environment.

In accordance with one aspect of the invention, there is provided an antenna device comprising a seat, an antenna member secured on the seat, a circuit board disposed between the seat and the antenna member, a light device attached to the circuit board, means for energizing the light device, and means for magnetically attracting the seat to an object, such as the vehicle, and for allowing the seat of the antenna device to be attached onto various kinds of objects with the magnetically attracting means, and for allowing the antenna device to be moved or adjusted to any suitable positions or places of the vehicle. The light device may generate the lights or the decorative lights.

The magnetically attracting means includes at least one magnetic member secured to the seat for attracting onto the object.

The magnetically attracting means includes at least one casing having a space formed therein for receiving the magnetic member.

The magnetically attracting means includes a protective cover layer attached to a bottom of the magnetic member for shielding and protecting the magnetic member.

The seat includes an upper wall having at least one hub extended upward therefrom, the circuit board includes at least one notch formed therein for receiving the hub and for securing the circuit board on the upper wall of the seat.

The antenna member includes a base engaged onto the upper wall of the seat, and includes at least one stud extended downward from the base and engaged with the hub, and a fastener engaged through the hub and engaged with the stud.

The seat includes a peripheral recess formed in the upper wall thereof, and a sealing ring engaged in the peripheral recess of the seat and engaged with the antenna member for making a water tight seal between the seat and the antenna device.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
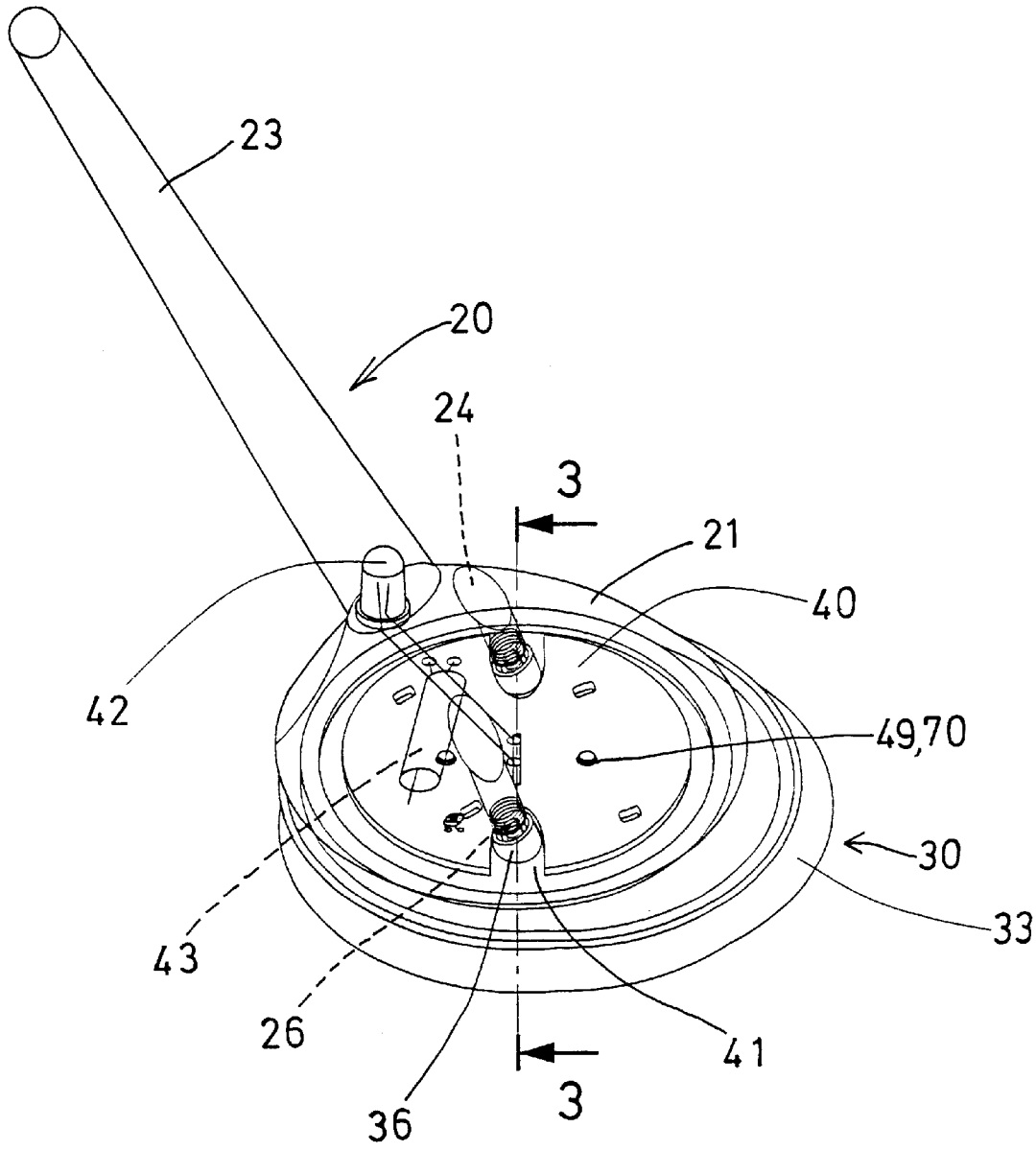
FIG. 1 is a perspective view of an antenna device in accordance with the present invention.
Figure 2:
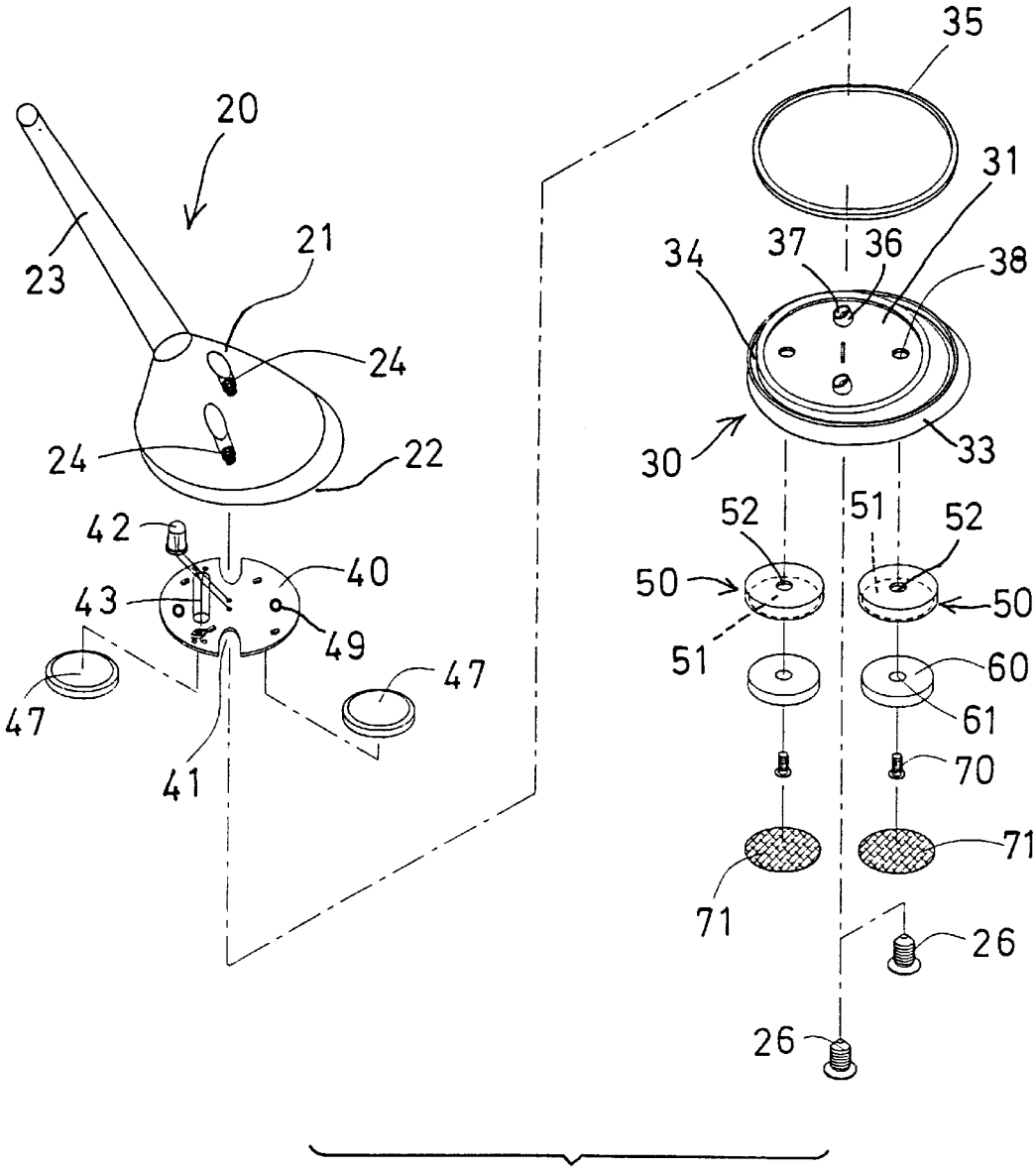
FIG. 2 is an exploded view of the antenna device.

Referring to the drawings, and initially to FIGS. 1–5, an antenna device in accordance with the present invention comprises a seat 30 including an upper wall 31, and a chamber 32 formed therein and formed or defined by a peripheral wall 33. The seat 30 further includes a peripheral recess 34 formed in the upper portion thereof for receiving a sealing ring 35 therein, and includes one or more hubs 36 extended upward from the upper wall 31 thereof, and includes one or more orifices 37 formed in the hubs 36 respectively and formed through the upper wall 31 thereof, and includes one or more screw holes 38 formed therein.

Figure 3:
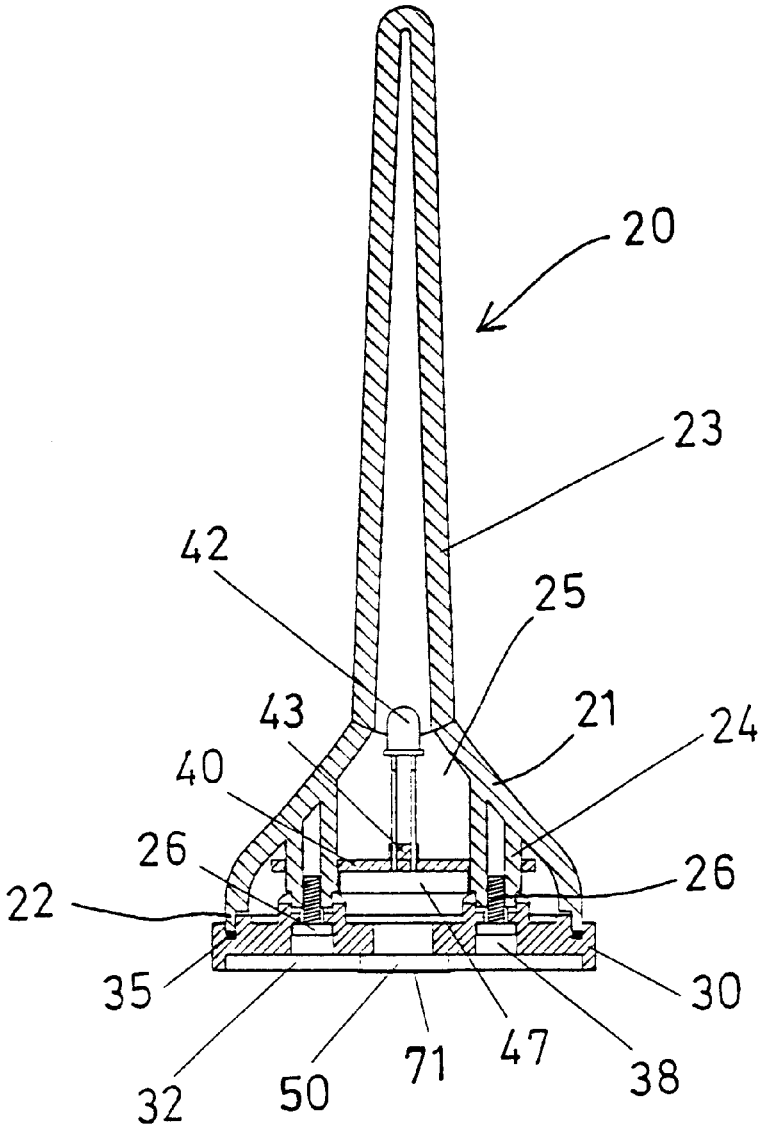
FIG. 3 is a cross sectional view taken along lines
Figure 4:
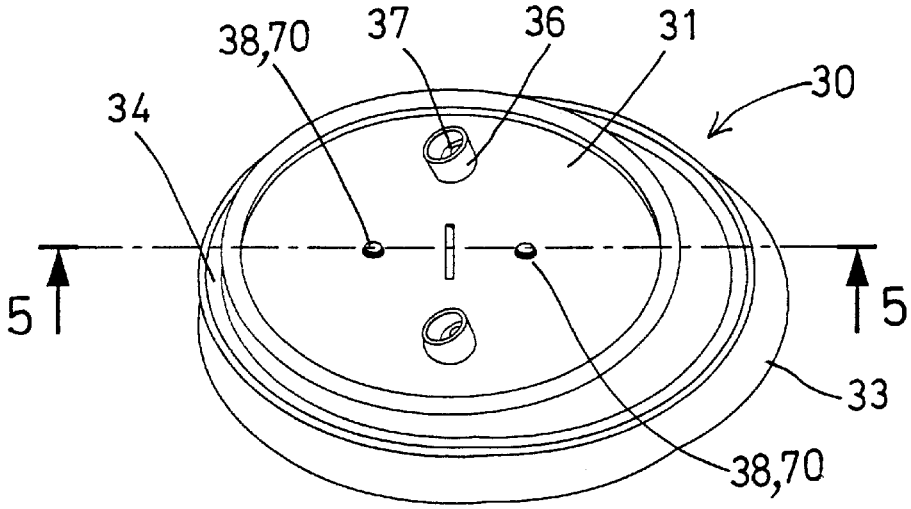
FIG. 4 is a perspective view illustrating the base portion of the antenna device.
Figure 5:
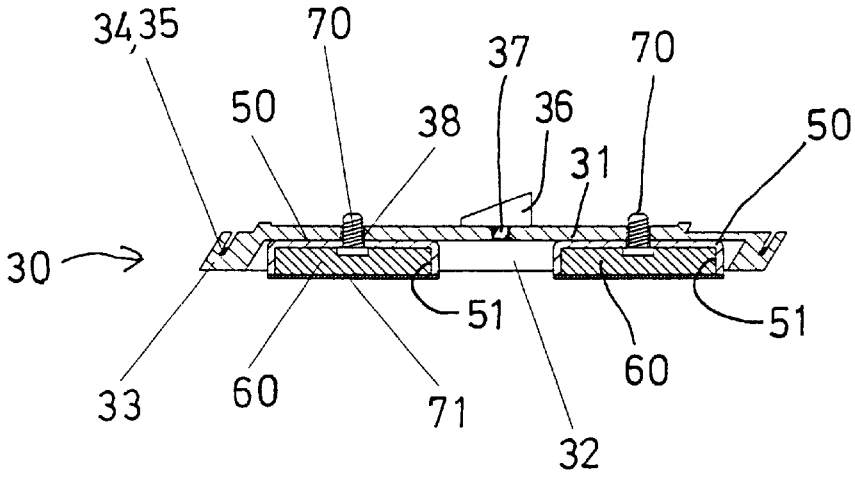
FIG. 5 is a cross sectional view taken along lines 5—5 of FIG. 4.
Figure 7:
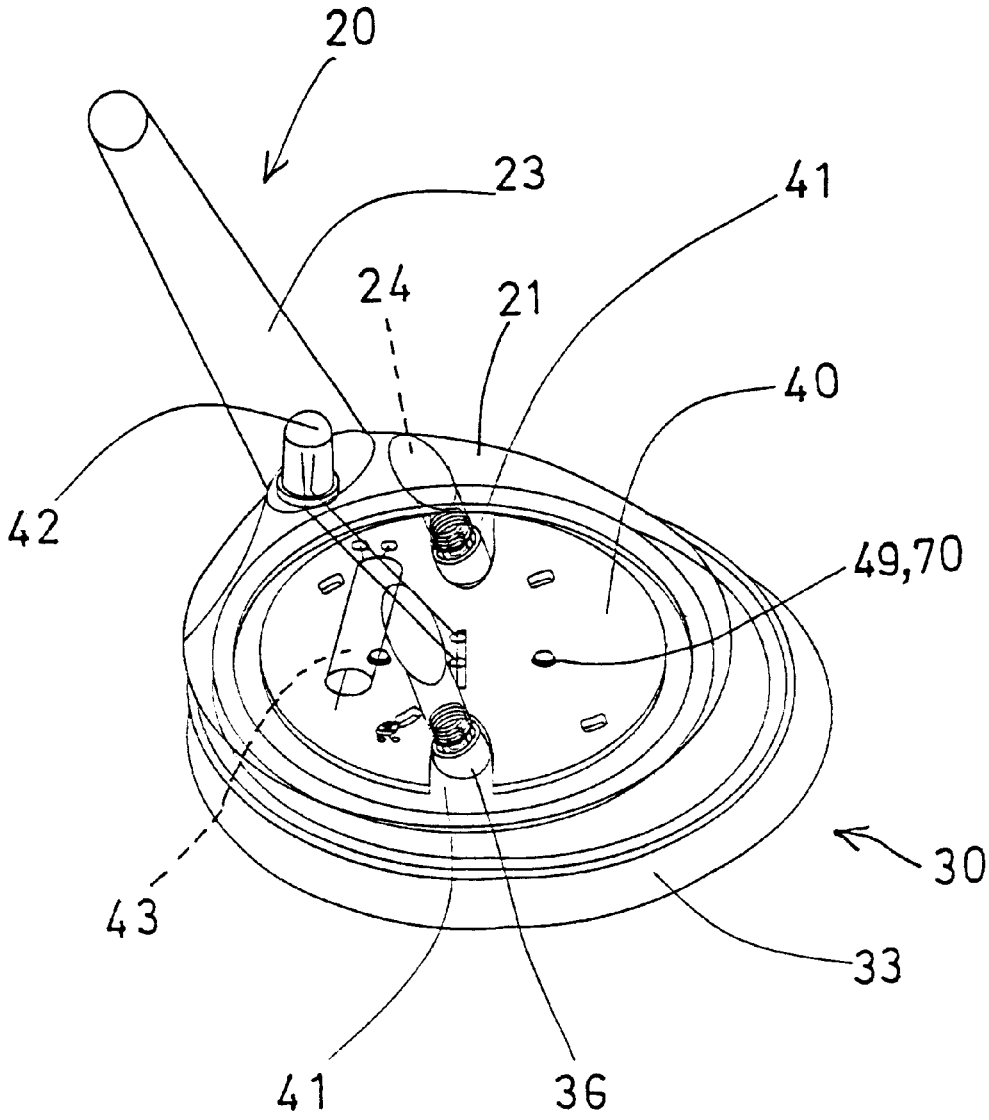
FIG. 7 is a perspective view illustrating the other arrangement of the antenna device.

An antenna member 20 includes a base 21 having a cone shape or frustum shape, and having a lower peripheral portion 22 engaged onto the upper wall 31 of the seat 30 and/or engaged onto the sealing ring 35 which may make a water tight seal between the base 21 of the antenna member 20 and the seat 30 (FIG. 3). The antenna member 20 includes an extension 23 extended from the base 21, and includes one or more studs 24 extended inward of the inner space 25 of the base 21. The extension 23 may be formed into different lengths (FIGS. 1, 7). One or more fasteners 26 may engage through the orifices 37 of the hubs 36 and may be threaded to the extensions 23 for securing the antenna member 20 to the seat 30.

A circuit board 40 is disposed on top of the upper wall 31 of the seat 30, and includes one or more notches 41 formed therein for receiving the hubs 36 and for preventing the circuit board 40 from rotating relative to the seat 30. One or more light devices 42 (FIGS. 1–3 and 6–11), such as the light emitting diodes 42 may be attached to the circuit board 40 for generating warning lights or decorative lights. One or more solar cells or the other batteries 47 may be provided and attached to the circuit board 40 for energizing the light devices 42.

One or more switches 43 (FIGS. 1–3 and 6–11), such as the vibrator switches, or the switches for detecting vibrations or shocks or the like, may further be provided and attached to the circuit board 40, and may be disposed between the batteries 47 and the light devices 42, for selectively energizing the light devices 42 when the vehicle 90 (FIG. 6) is on the road, or when vibrations and shocks are transmitted to the antenna device. The circuit board 40 may include the other electric elements or parts, such as a memory or a processor device 80 (FIGS. 8–11) for acting as the typical antenna or for conducting the works of the antenna devices.

One or more casings 50 are further provided and received in the chamber 32 of the seat 30, and each includes a space 51 formed therein, and an orifice 52 formed therein. One or more magnetic members 60 are received in the spaces 51 of the casings 50 respectively, and each includes an aperture 61 formed therein for aligning with the orifices 52 of the casings 50 respectively. One or more fasteners 70 are engaged through the apertures 61 of the magnetic members 60 and the orifices 52 of the casings 50, and threaded to the screw holes 38 of the seat 30, for securing the magnetic members 60 to the seat 30. The fasteners 70 may further be provided and threaded with the screw holes 49 of the circuit board 40 (FIGS. 1, 7), for solidly securing the circuit board 40 to the seat 30.

Figure 6:
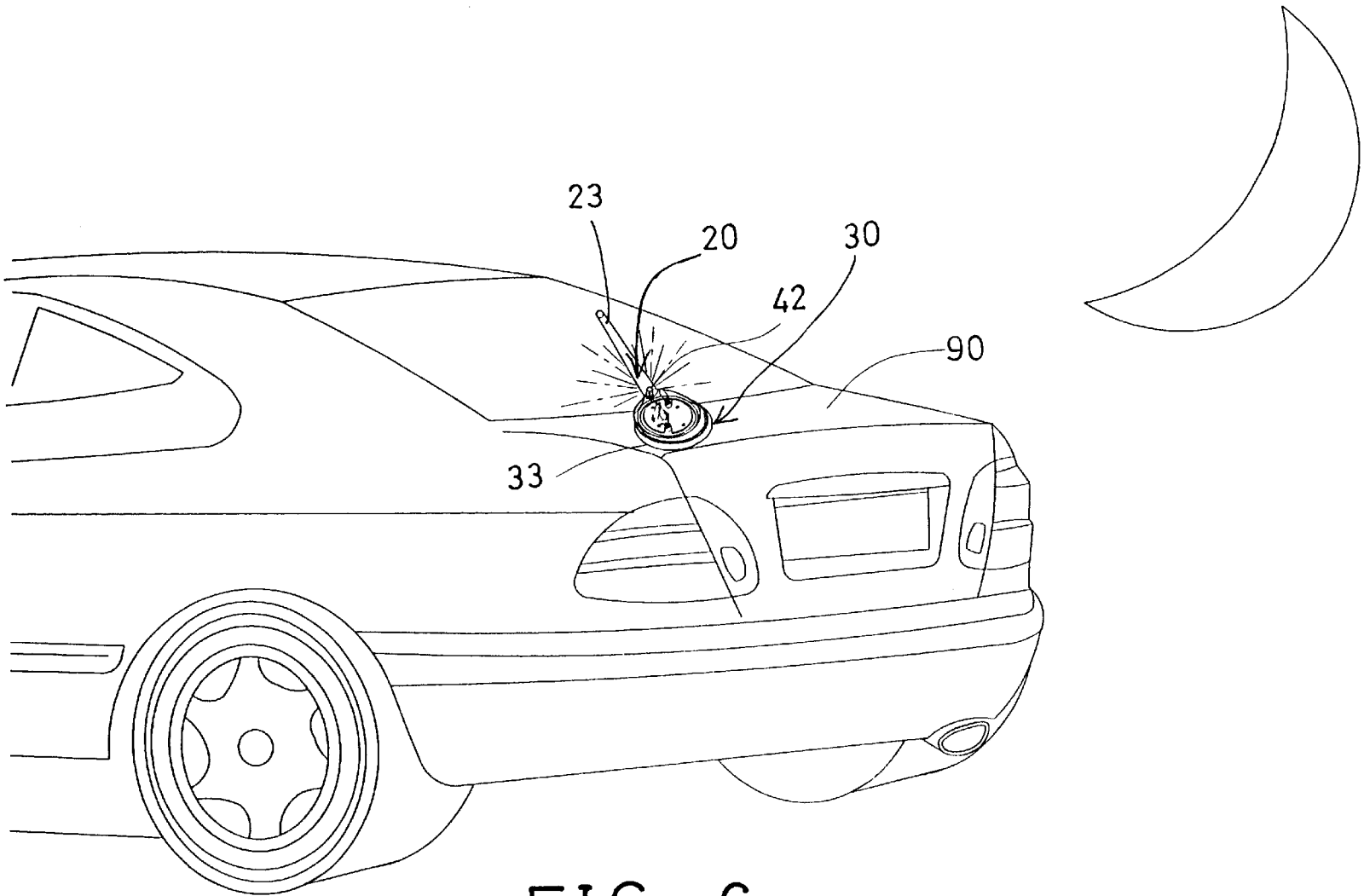
FIG. 6 is a perspective view illustrating the attachment of the antenna device onto the vehicle.

In operation, as shown in FIG. 6, the magnetic members 60 may be used for attracting onto the other metal or magnetic attractable materials, such as the metal outer housing of the vehicle 90, and for attaching onto various kinds of objects with magnetic members 60, and for allowing the antenna device to be moved or adjusted to various places or positions of the vehicles 90. A protective cover layer 71 may further be provided and attached to the bottom of each of the magnetic members 60 or the casings 50, with such as the adhesive materials, or the hook and loop devices, or the like, for shielding and protecting the magnetic members 60 from being dirtied or rusted.

Figure 9:
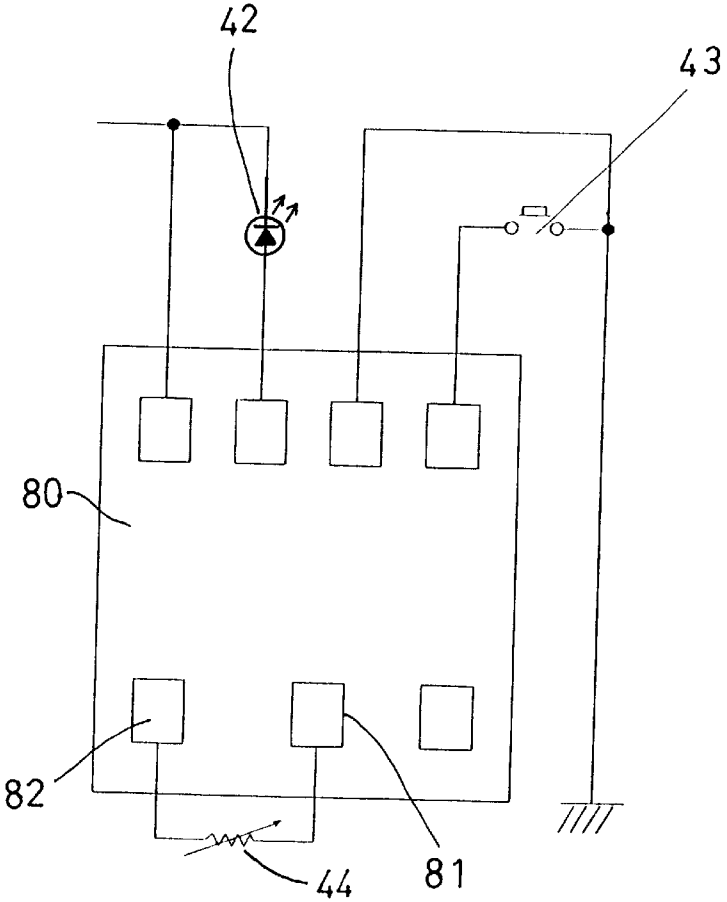
FIGS. 9, 10, 11 are diagrams similar to FIG. 8, illustrating the other examples of the electric circuit of the antenna device.
Figure 8:
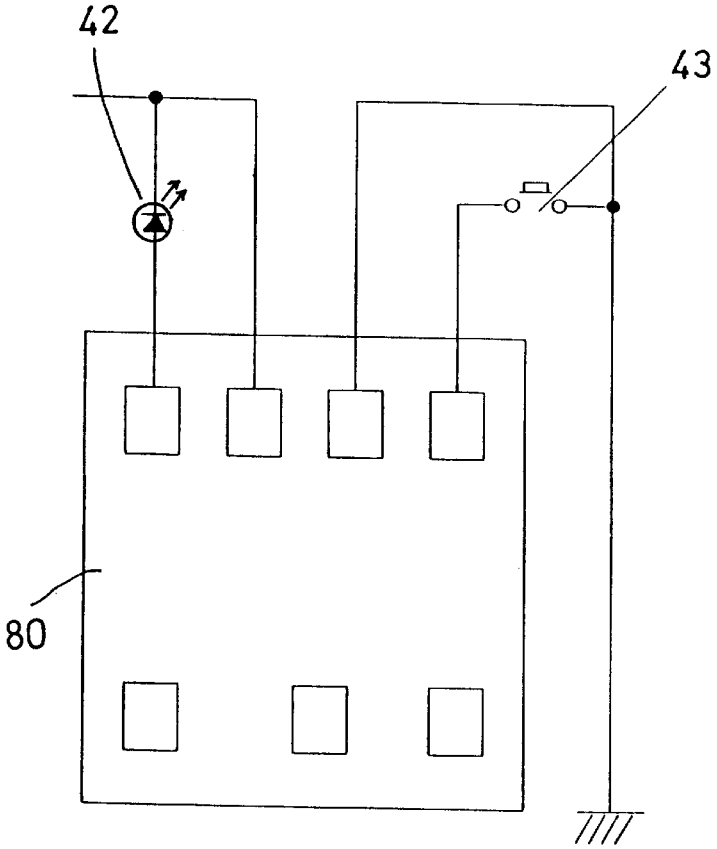
FIG. 8 is a diagram illustrating one example of the electric circuit of the antenna device.
Figure 11:
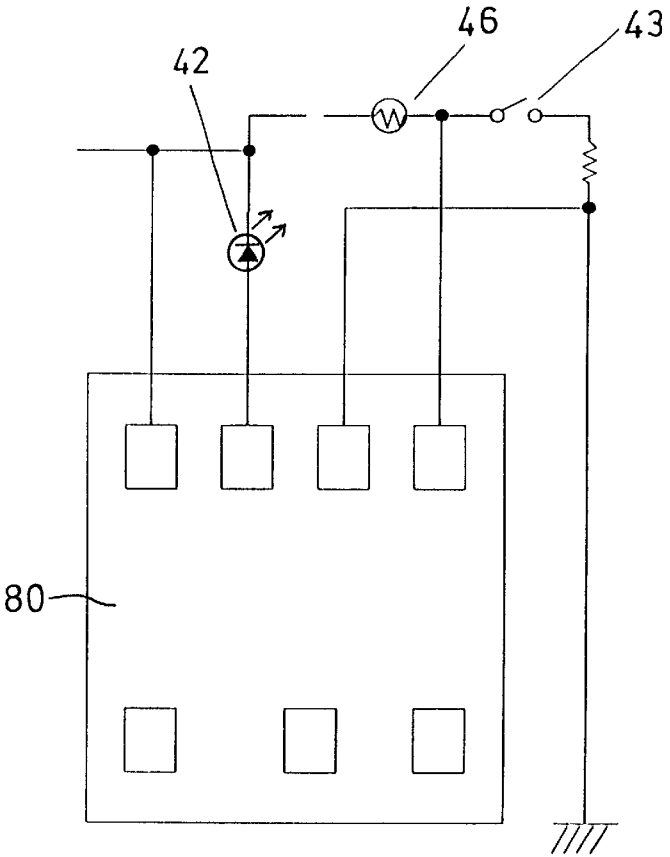
Figure 10:
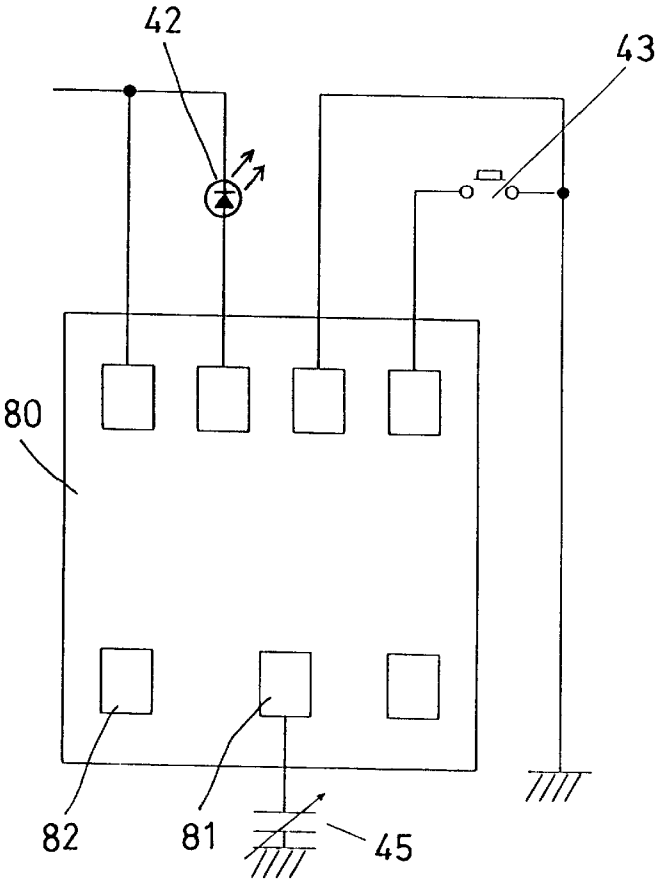

Referring next to FIG. 9, a variable resistor 44 may further be provided and attached to two conductor terminals 81, 82 of the processor device 80, to which the light emitting diode 42 and the switch 43 are coupled thereto. The variable resistor 44 may be used for increasing the flashing or lighting speed of the light devices 42. Referring next to FIG. 10, a conductor 45 may further be provided and attached to one of the conductor terminals 81 of the processor device 80. The conductor 45 may be used for decreasing the flashing or lighting speed of the light devices 42. Referring next to FIG. 11, a photo detector 46 may further be provided and coupled between the light device 42 and the switch 43, for selectively actuating the light devices 42, and for generating warning or decorative lights during the night or in the dark environment.

The antenna device may thus be selectively attached onto various kinds of magnetically attractable materials of various kinds of objects with the magnetic members 60, or with the other magnetic devices, such as the electromagnetic devices. The warning lights generated by the light devices 42 may also be used for allowing the vehicle to be seen from the sides of the vehicles, and for preventing the vehicles from being hit by the other vehicles from the side portion thereof.

Accordingly, the antenna device in accordance with the present invention may be attached onto various kinds of objects with magnetic members and may be moved or adjusted to various places or positions of the vehicles, and may include a light device for generating warning lights during the night or in the dark environment.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An antenna device comprising:

a seat including an upper wall having at least one hub extended therefrom, an antenna member including a base engaged onto said upper wall of said seat, and including at least one stud extended from said base and engaged with and secured to said at least one hub, a circuit board disposed between said seat and said antenna member, and including at least one notch formed therein to receive said at least one hub of said seat and to secure said circuit board on said upper wall of said seat, a light device attached to said circuit board, means for energizing said light device, at least one casing having a space formed therein, at least one magnetic member received in said space of said at least one casing, and means for securing said at least one magnetic member and said at least one casing to said seat for attracting onto an object.

2. The antenna device according to claim 1 further comprising a protective cover layer attached to a bottom of said at least one magnetic member for shielding and protecting said least one magnetic member.

3. The antenna device according to claim 1, wherein said seat includes a peripheral recess formed in said upper wall thereof, and a sealing ring engaged in said peripheral recess of said seat and engaged with said antenna member for making a water tight seal between said seat and said antenna member.

* * * * *